US009857740B2

(12) United States Patent
Morita et al.

(10) Patent No.: US 9,857,740 B2
(45) Date of Patent: Jan. 2, 2018

(54) IMAGE FORMING APPARATUS AND METHOD INCLUDING SHEET SEPARATION PERFORMANCE DETERMINATION

(71) Applicant: Konica Minolta, Inc., Chiyoda-ku, Tokyo (JP)

(72) Inventors: Sayaka Morita, Gamagori (JP); Shigeru Tashiro, Toyokawa (JP); Yoshihiro Murakoshi, Toyokawa (JP)

(73) Assignee: KONICA MINOLTA, INC., Chiyoda-ku, Tokyo (JP)

( * ) Notice: Subject to any disclaimer, the term of this patent is extended or adjusted under 35 U.S.C. 154(b) by 0 days.

(21) Appl. No.: 15/233,353

(22) Filed: Aug. 10, 2016

(65) Prior Publication Data

US 2017/0045846 A1 Feb. 16, 2017

(30) Foreign Application Priority Data

Aug. 10, 2015 (JP) ..... 2015-157872

(51) Int. Cl.
*G03G 15/20* (2006.01)
*G03G 15/00* (2006.01)

(52) U.S. Cl.
CPC ..... *G03G 15/2028* (2013.01); *G03G 15/5062* (2013.01); *G03G 15/6585* (2013.01); *G03G 2215/00805* (2013.01)

(58) Field of Classification Search
CPC ..... G03G 15/2028; G03G 15/5062; G03G 15/6585; G03G 2215/00805
USPC ..... 399/323
See application file for complete search history.

(56) References Cited

U.S. PATENT DOCUMENTS

2011/0064494 A1* 3/2011 Amita ..... G03G 15/2064 399/341

FOREIGN PATENT DOCUMENTS

JP 2007-108618 A 4/2007
JP 2010-026174 A 2/2010

* cited by examiner

*Primary Examiner* — Susan Lee
(74) *Attorney, Agent, or Firm* — Buchanan Ingersoll & Rooney PC

(57) ABSTRACT

An image forming apparatus includes: an image forming unit for forming a toner image and transferring the toner image to a sheet material; a fixing device for fixing the transferred toner image to the sheet material; a measurement device for measuring the gloss of the toner image fixed to the sheet material; a separator for separating the sheet material from the fixing device; and a controller which determines a performance of separating the sheet material from the fixing device based on an output from the measurement device and controls the operation of the separator.

12 Claims, 12 Drawing Sheets

IMAGE FORMING APPARATUS AND METHOD INCLUDING SHEET SEPARATION PERFORMANCE DETERMINATION

RELATED APPLICATION

The priority application Number Japanese Patent Application 2015-157872 upon which this application is based is hereby incorporated by reference.

BACKGROUND OF THE INVENTION

Field of the Invention

The present invention relates to an image forming apparatus for use in copiers, printers, facsimiles and multi-functional peripheries thereof. Particularly, the invention relates to an image forming apparatus which includes: an image forming unit for forming a toner image and transferring the toner image to a sheet material; a fixing device for fixing the transferred toner image to the sheet material; and a separator for separating the sheet material from the fixing device, and which is adapted to determine a performance of separating the sheet material from the fixing device based on the gloss of the toner image fixed to the sheet material by the fixing device and to control the operation of the separator.

Description of the Related Art

In the image forming apparatus for use in copiers, printers, facsimiles and multi-functional peripheries thereof, the sheet material having the toner image formed thereon is transported to the fixing device by which the toner image is heat fixed to the sheet material and thereafter, the sheet material is discharged from the main body of the image forming apparatus.

More recently, there has been a demand for printing on a variety of sheet materials such as specialty paper and films as a value-added service in production print field. In the meantime, there is a problem of so-called sheet jam caused by separation failure. If the sheet material has an insufficient stiffness against adhesion between the sheet material and a fixing member when a toner is softened in the fixing device, the sheet material is wound around the fixing member.

The stiffness of the sheet material varies depending upon histories of temperature and moisture and hence, varies with the manufacture lot or the timing of use. In order to ensure sheet separation under a variety of conditions in a certain setting, therefore, the device is required to acquire an excessive sheet separating performance.

Air separation and the like are known as a countermeasure against the sheet jam associated with separation failure. However, such a measure involves adverse effects such as increased energy consumption. It is therefore desirable to efficiently operate the separator only when the image is fixed to a sheet material involving a fear of sheet separation failure.

The fixing device in the image forming apparatus is configured to pass the sheet material through a nip formed between a heated fixing roller and a pressure roller pressed against the fixing roller and to advance the sheet material forward while heat fixing the transferred image. If, at this time, the sheet material is made to adhere to the surface of the fixing roller by an adhesive power of the toner melted by the heat of the nip, the sheet jam is induced due to the separation failure where the sheet material is not separated from the fixing roller. In the worst case, the sheet material is completely wound around an outer periphery of the fixing roller, requiring a considerable amount of cost and time for maintenance work.

In this connection, the fixing device adopts an arrangement where a release layer based on a fluorine resin is formed on the surface of the fixing roller such as to facilitate the separation of the sheet material. The arrangement is so devised as to allow the sheet material to separate from the fixing roller naturally by taking advantage of the curvature of the outer periphery of the fixing roller and the stiffness of the sheet material per se.

However, in a case where a sheet material having low stiffness such as thin paper and thin coated paper is used or where a solid image is formed with a large amount of toner deposited on the sheet material, the risk of the sheet jam caused by separation failure naturally increases.

As a solution to the above problem, for example, a separation-claw type separator is known which has a separation claw abutted on the outer periphery of the fixing roller so as to forcibly separate the sheet material therefrom. However, with the separation claw normally abutted thereon, the outer periphery of the fixing roller becomes worn at an area in contact with the separation claw. This may result in irregular fixing performance.

The separator may also adopt an air separation method in place of the above-described claw separation method. The separator is adapted to forcibly separate the sheet material in a non-contact fashion by applying a sharp blast of air from a nozzle tip to an infinitesimal gap between a leading end of the sheet material and the outer periphery of the fixing roller.

In this case, however, the applied blast air constantly removes heat from the fixing roller, which leads to a problem that a large amount of electric power is consumed for maintaining the fixing roller at a fixing temperature.

In this connection, a patent document 1 (JP-A No. 2007-108618) proposes a separator which adopts the separation claw method and is adapted to operate a sheet separating mechanism only when the performance of separating the sheet material from the fixing roller is low. The patent document 1 discloses an arrangement where a sheet winding index value is calculated based on a distance to the leading end of the sheet material passed through the nip formed between the fixing roller and the pressure roller, as measured by a laser displacement sensor. When the sheet winding index value exceeds a predetermined value, the apparatus determines that the sheet separating performance is lowered because of the end of service life of the fixing roller. The apparatus alerts a user to the lowered sheet separating performance and operates the sheet separating mechanism for forcibly separating the sheet materials in the subsequent sheet passing operation.

The following effects can be obtained if the above-described technique is applied to the arrangement where the performance of separating the sheet material is determined and the sheet separating mechanism is operated only when the sheet separating performance is low. In the case of the separation claw method, the fixing roller is notably reduced in flaws generated in the outer periphery thereof and hence, is improved in durability. In a case where the sheet separating mechanism is of the air separation type, the sheet separating mechanism need not constantly apply the blast air to the fixing roller. This is effective to obviate a problem that a large amount of electric power is consumed to compensate for the heat removed from the fixing roller.

According to the patent document 1, however, the laser displacement sensor used for the determination of the performance of separating the sheet material commonly makes measurement by detecting the displacement of a spot of reflected laser light from the surface of the sheet material and hence, may sometimes fail to achieve correct detection because of the influence of curl, waviness or loop of the sheet material, or air current.

A patent document 2 (JP-A No. 2010-26174) discloses an arrangement made based on a finding that the gloss of a toner image on the sheet material corresponds to a force which is derived from the adhesive power of the toner and makes the sheet material stuck to the fixing roller. In this arrangement, the separation claw variable in position to separate the sheet material from the fixing roller is supportedly moved, while a force exerted on the separation claw separating the sheet material from the fixing roller is measured inchmeal. The separation claw is controllably moved to a position corresponding to the highest value of the force exerted on the separation claw.

In the arrangement of the patent document 2, however, the force which makes the sheet material stuck to the fixing roller is increased in order to increase the gloss of the toner image on the sheet material, while the separation claw is operated to separate the sheet material from the fixing roller. This involves a potential problem that the separation claw may damage the fixing roller.

SUMMARY OF THE INVENTION

The invention is directed to simple equipment for proper determination of the performance of separating the sheet material with the fixed toner image and to adequate prevention of the separation failure resulting from the sheet material wound on the fixing device.

According to an aspect of the invention for achieving at least one of the above objects, an image forming apparatus includes: an image forming unit for forming a toner image and transferring the toner image to a sheet material; a fixing device for fixing the transferred toner image to the sheet material; a measurement device for measuring the gloss of the toner image fixed to the sheet material by the fixing device; a separator for separating the sheet material from the fixing device; and a controller which determines a performance of separating the sheet material from the fixing device based on an output from the measurement device and controls the operation of the separator.

These and other objects, advantages and features of the invention will become apparent from the following description thereof taken in conjunction with the accompanying drawings which illustrate specific embodiments of the invention.

BRIEF DESCRIPTION OF THE DRAWINGS

The above and other objects, advantages and features of the invention will become more fully understood from the detailed description given hereinbelow and the appended drawings which are given by way of illustration only, and thus are not indented as a definition of the limits of the present invention, and wherein:

FIG. 4A is a schematic explanatory diagram showing a state where the fixing device exhibits a good sheet separating performance in the image forming apparatus according to the above embodiment, while

FIG. 5A is an explanatory diagram showing a measurement result of the gloss of a toner image formed on the sheet material in the image forming apparatus according to the above embodiment or an example of good sheet separating performance, while

DESCRIPTION OF THE PREFERRED EMBODIMENTS

Figure 1:
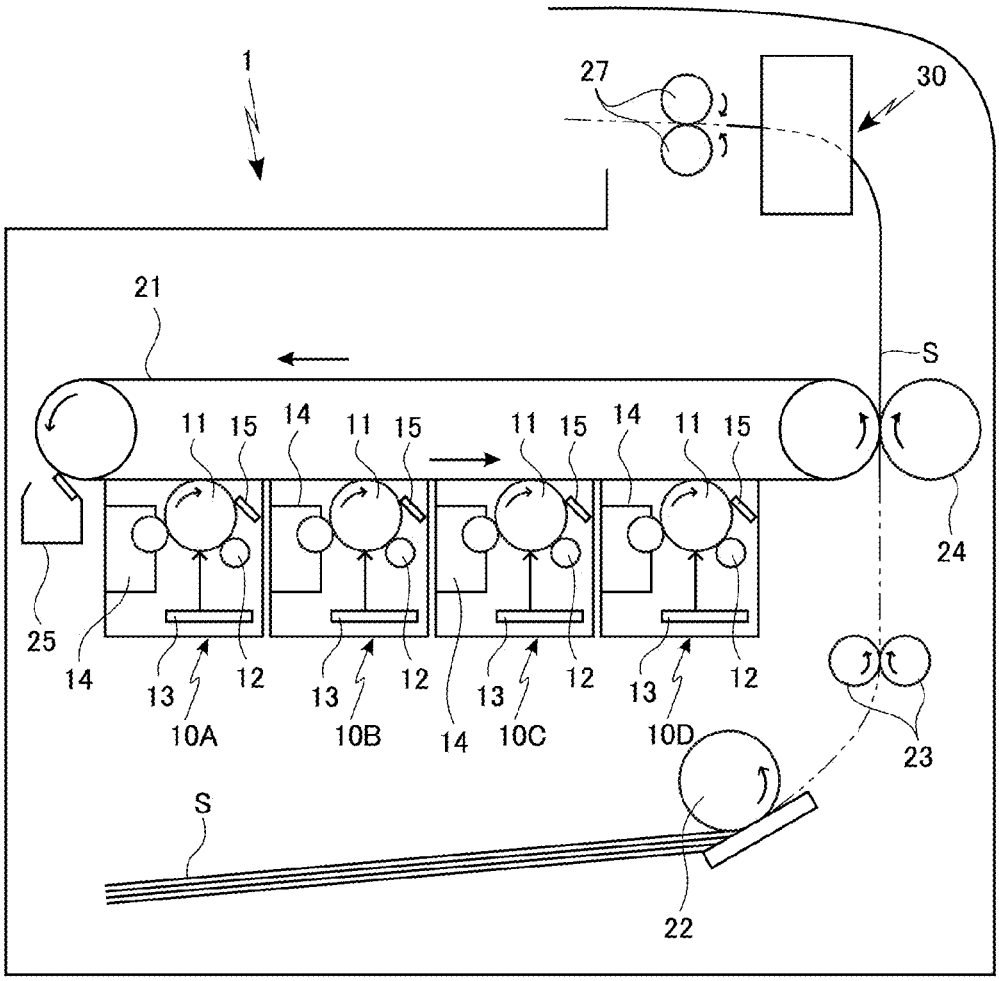
FIG. 1 is a schematic explanatory diagram showing how a toner image is formed on a sheet material in an image forming apparatus according to an embodiment of the invention.

Hereinafter, an embodiment of the present invention will be described with reference to the drawings. However, the scope of the invention is not limited to the illustrated examples.

An image forming apparatus of the invention includes: an image forming unit for forming a toner image and transferring the toner image to a sheet material as described above; a fixing device for fixing the transferred toner image to the sheet material; a measurement device for measuring the gloss of the toner image fixed to the sheet material by the fixing device; a separator for separating the sheet material from the fixing device; and a controller which determines a performance of separating the sheet material from the fixing device based on an output from the measurement device and controls the operation of the separator.

According to the image forming apparatus of the invention, the gloss of the toner image fixed to the sheet material by the fixing device is measured by the measurement device, while the controller determines the performance of separating the sheet material from the fixing device based on the output from the measurement device and controls the operation of the separator based on the resultant determination. Therefore, the image forming apparatus is adapted to control the deterioration of the fixing device and the increase in power consumption.

It is preferred in the above image forming apparatus that the measurement device takes measurements on the gloss of the toner image at plural points in a transport direction of the sheet material, while the controller determines the performance of separating the sheet material based on outputs of the measurements taken by the measurement device at the plural points in the transport direction of the sheet material.

The above image forming apparatus can be configured such that a toner image of a predetermined test pattern transferred to a sheet material is fixed to the sheet material by the fixing device, that the gloss of the fixed toner image of the test pattern is measured by the measurement device, and that the controller determines the performance of separating the sheet material based on the output from the measurement device and controls the operation of the separator.

The above image forming apparatus is preferably configured such that the measurement device is movable in a direction perpendicular to the transport direction of the sheet material discharged from the fixing device, and is moved to a region where the amount of toner deposition is equal to or more than a certain value, so as to measure the gloss of the toner image at the region.

It is further preferred that the measurement device takes measurements of the gloss of the toner image at plural points in a direction perpendicular to the transport direction of the sheet material discharged from the fixing device, while the controller determines the performance of separating the sheet material based on the outputs of measurements taken by the measurement device at the plural points and controls the operation of the separator.

The above image forming apparatus can be configured such that if the gloss of the toner image as measured by the measurement device is higher than a predetermined value, the controller determines that the performance of separating the sheet material is low and operates the separator without changing the fixing property of the sheet material.

The above image forming apparatus can be configured such that if the gloss of the toner image as measured at a high coverage part thereof by the measurement device is lower than a predetermined value, the controller determines that the performance of separating the sheet material is low and operates the separator in a manner to lower the fixing property of the sheet material.

As shown in FIG. 1, an image forming apparatus 1 according to an embodiment of the invention incorporates therein four imaging cartridges 10A to 10D.

Each of the imaging cartridges 10A to 10D includes: a photoreceptor 11; a charging device 12 for electrically charging a surface of this photoreceptor 11; an exposure device 13 for forming an electrostatic latent image on the photoreceptor surface 11 by exposing the charged surface of the photoreceptor 11 to light according to image information; a developing device 14 for forming a toner image by supplying a toner to the electrostatic latent image formed on the photoreceptor surface 11; and a cleaning device 15 for removing the toner remaining on the photoreceptor surface 11 after the transfer of the toner image formed on the photoreceptor surface 11 to an intermediate transfer belt 21.

The developing devices 14 of the imaging cartridges 10A to 10D contain toners of different colors, namely black toner, yellow toner, magenta toner and cyan toner, respectively.

In this image forming apparatus 1, each of the imaging cartridges 10A to 10D forms the toner image of its specific color on the photoreceptor surface 11 by taking the steps of: charging the photoreceptor surface 11 by means of the charging device 12; forming the electrostatic latent image corresponding to the image information on the photoreceptor surface 11 by exposing the charged photoreceptor surface 11 to light according to the image information by means of the exposure device 13; and forming the toner image of its specific color on the photoreceptor surface 11 by supplying the toner of its specific color from the developing device 14 to the electrostatic latent image on the photoreceptor surface 11.

Subsequently, the toner images of the respective colors formed on the photoreceptor surfaces 11 of the imaging cartridges 10A to 10D are sequentially transferred to the intermediate transfer belt 21 so as to form a composite toner image on the intermediate transfer belt 21. In the meantime, the toners remaining on the respective photoreceptor surfaces 11 after image transfer are removed therefrom by the respective cleaning devices 15.

A sheet material S stored in this image forming apparatus 1 is fed to a timing roller 23 by a sheet feed roller 22. This timing roller 23 delivers the sheet material S to space between the intermediate transfer belt 21 and a transfer roller 24 in a suitable timing, permitting the toner image formed on the intermediate transfer belt 21 to be transferred to the sheet material S. The toners not transferred to the sheet material S and remaining on the intermediate transfer belt 21 are removed therefrom by a second cleaning device 25.

The sheet material S with the transferred toner image is delivered to a fixing device 30, by which the toner image is fixed to the sheet material S. Subsequently, the sheet material S with the fixed toner image is discharged by a sheet discharge roller 27.

Next, the fixing device 30 according to an embodiment of the invention is specifically described.

Figure 2:
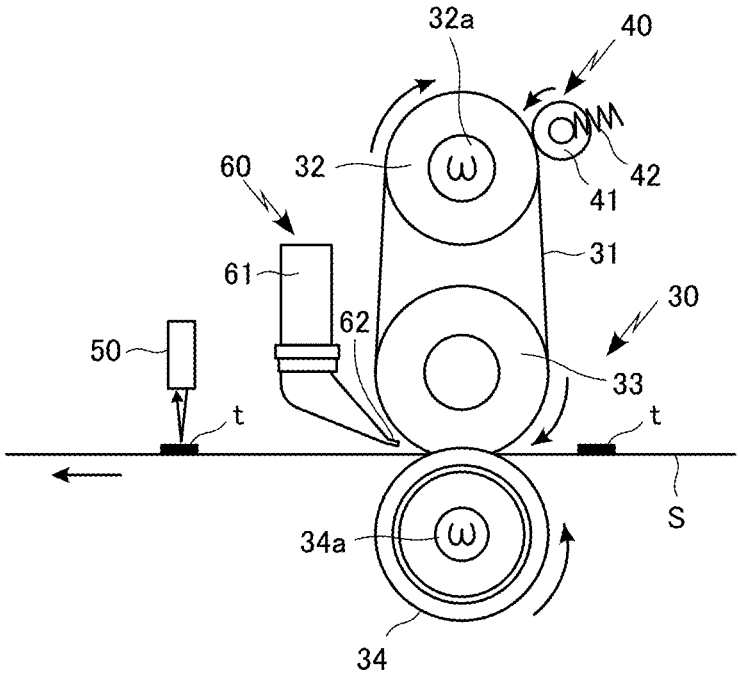
FIG. 2 is a schematic explanatory diagram showing how a fixing device fixes the toner image to the sheet material in the image forming apparatus according to the above embodiment.

As shown in FIG. 2, the fixing device 30 according to this embodiment employs an endless fixing belt 31 as a fixing member. This fixing belt 31 is entrained between a heat roller 32 and a fixing-side pressure roller 33 and is heated by the heat roller 32.

This fixing device 30 further employs a pressure roller 34 as a pressing member. As pressed against the fixing-side pressure roller 33 via the fixing belt 31, the pressure roller 34 is rotated by a rotating device (not shown) such that the fixing belt 31 and fixing-side pressure roller 33 are driven to rotate in conjunction with the rotation of the pressure roller 34.

The sheet material S with the toner image t thus formed is fed into a nip between the pressure roller 34 and the fixing belt 31 in a manner to make contact with the fixing belt 31 on its side carrying the toner image t. In this nip, the toner image t is fixed to the sheet material S by heating and pressing the sheet material S between the pressure roller 34 and the fixing belt 31.

The fixing belt 31 can employ, for example, a belt including an elastic layer made of silicone rubber or the like, and a surface release layer made of a fluorine-based resin, which are laminated in this order on an outside surface of a film substrate made of heat-resistant polyimide. Examples of the usable fluorine-based resin include: PFA (perfluoroalkoxy alkane), PTFE (polytetrafluoroethylene), FEP (tetrafluoroethylene hexafluoropropylene copolymer), and the like. It is particularly preferred to use any one of PFA, PTFE and FEP in the light of enhancing the releasability of the fixing belt surface 31 from wax contained in the toner resin or toner particles and preventing toner adhesion to the fixing belt surface 31 during fixing operation.

The heat roller 32 can employ, for example, a roller which includes a cylindrical core metal made of aluminum or the like and a resin layer of PTFE or the like formed on an outer periphery of the core metal, and which contains therein a heating element 32*a* such as a halogen heater. Such a heating roller 32 can be replaced by an electromagnetic induction heating element (not shown). In this case, a material capable of electromagnetic induction heating such as Ni is added in the substrate of the fixing belt 31.

The fixing-side pressure roller 33 can employ, for example, a roller including a cylindrical core metal made of iron or the like and an elastic layer of silicone rubber or the like formed on an outer periphery of the core metal. This fixing-side pressure roller 33 may further include a surface release layer of a fluorine-based resin formed on an outside surface of the elastic layer.

The pressure roller 34 can employ, for example, a roller which includes a cylindrical core metal made of aluminum or the like and an elastic layer of silicone rubber or the like formed on an outer periphery of the core metal, and which contains therein a heating element 34*a* such as a halogen heater similarly to the above heat roller 32. This pressure roller 34 is also adapted to heat the sheet material S with the toner image t. It is noted that the pressure roller 34 can also dispense with the heating element 34*a*.

The sheet material S with the toner image t thus formed is fed into the nip between the pressure roller 34 and the fixing belt 31 in a manner to make contact with the fixing belt 31 on its side carrying the toner image t. In the nip, the sheet material S with the toner image t is heated and pressed so that the toner image t is fixed to the sheet material S.

This fixing device 30 is provided with a cleaning device 40 for cleaning the surface of the fixing belt 31.

The cleaning device 40 is configured such that a roller-shaped cleaning member 41 is urged by an urging member 42 such as a spring so as to be rotatably placed in contact with the fixing belt surface 31 and to clean off substances adherent to the fixing belt surface 31. The cleaning member 41 is not particularly limited to such a roller-shaped member but may have any configuration, such as scraper shape or web shape, that is adapted to remove the substances adherent to the fixing belt surface 31.

The fixing device 30 must reliably separate the sheet material S from the fixing belt 31 because the passage of the sheet material S with the heat fixed image through the nip involves the potential fear of sheet separation failure. Depending upon the amount of toner deposition on the sheet material S, the toner may adhere to the outside surface of the fixing belt 31 so as to lower the performance of separating the sheet material S. This may result in the sheet jam associated with separation failure.

According to this embodiment, therefore, a separator is provided for separating the sheet material S from the fixing belt 31. This embodiment employs, as the separator, an air separator 60 which separates the sheet material S from the fixing belt 31 by blowing air against the leading end of the sheet material S immediately upon the passage through the nip.

As shown in FIG. 2, the air separator 60 is configured such that a duct body 61 contains therein a fan (not shown), which is driven to blow air through a nozzle 62. The nozzle 62 desirably has a length in a width direction of the fixing belt 31 (the direction perpendicular to the sheet transport direction) substantially equal to the width of the largest sheet material used in the image forming apparatus 1. However, the nozzle may be shorter than the width of the sheet material S so long as the nozzle is effective to separate the sheet material S from the fixing belt 31.

The sheet material S is normally provided with margins of several millimeters on the edges thereof. Hence, a marginal area at the leading end of the sheet material S though the nip is separated from the fixing belt 31 due to the stiffness thereof, producing a gap. The sheet material S can be separated from the fixing belt 31 by blowing air into the gap.

In the operation, a controller 100 controls ON/OFF switching and air volume of the fan of the air separator 60 according to the performance of separating the sheet material S from the fixing belt 31. The control provided by the controller 100 will be described hereinlater.

The controller 100 makes adjustment of the air volume of the air separator 60. When the air separator 60 is not operative, the controller 100 controls the fan to stop air or to reduce the air volume. When the air separator is operative, the controller 100 controls the fan to blow air or to increase the air volume. By operating the air separator 60 only when needed, the controller can reduce electric power consumed by the fan and suppress the increase of the heating energy of the fixing device 30 because of the air that cools the fixing device 30.

It is known that with the increase in the gloss of the sheet material S, the force which is derived from the adhesive power of the toner and makes the sheet material S stuck to the fixing belt 31 is increased. In this embodiment, the performance of separating the sheet material S from the fixing belt 31 is determined based on optical detection of the gloss of the toner image t fixed to the sheet material S. In the embodiment, therefore, an optical detection sensor 50 is disposed at place downstream from the fixing device 30 so as to serve as a measurement device for measuring the gloss of the toner image fixed to the sheet material S by the fixing device 30.

Figure 3:
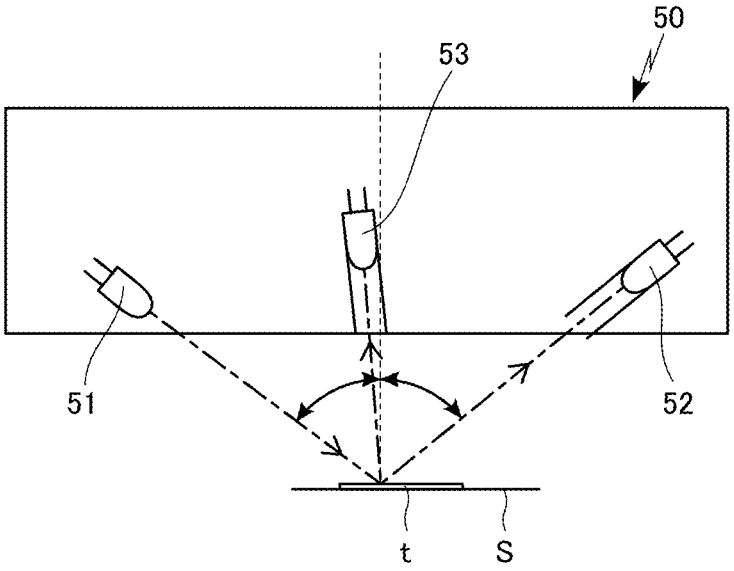
FIG. 3 is a schematic explanatory diagram showing an optical detection sensor employed by the image forming apparatus according to the above embodiment.

As shown in FIG. 3, for example, this optical detection sensor 50 is configured such that light emitted from a light-emitting element 51 is reflected by the toner image t on the sheet material S while the components of the reflected light are detected by photosensitive elements 52, 53. The intensity of the reflected light detected by the photosensitive elements 52, 53 is detected as the gloss.

The photosensitive element 52 of the optical detection sensor 50 is disposed at a position to detect a specular reflection component of the irradiated light while the photosensitive element 53 is disposed at a position to detect a diffuse reflection component of the irradiated light. In the optical detection sensor 50 of FIG. 3, the photosensitive elements 52, 53 detect the specular reflection light and the diffuse reflection light, respectively. However, the optical detection sensor may also be configured such that either one of the specular reflection light and the diffuse reflection light is detected by one photosensitive element. It is noted that an adequate sensitivity is more likely to be achieved by the detection of the specular reflection light.

The specular reflection light is intensively detected in a direction symmetrical with respect to the vertical line through the image surface of the sheet material S. The specular reflection light from a high-gloss image tends to be intense. The diffuse reflection light is detected at an angle apart from the detection angle of the specular reflection light. An image with less specular reflection light tends to increase in diffuse reflection light. The diffuse reflection light increases with increase in the amount of toner. The detection of specular reflection light and diffuse reflection light provides the detection of high gloss, toner amount or the like.

Figure 7:
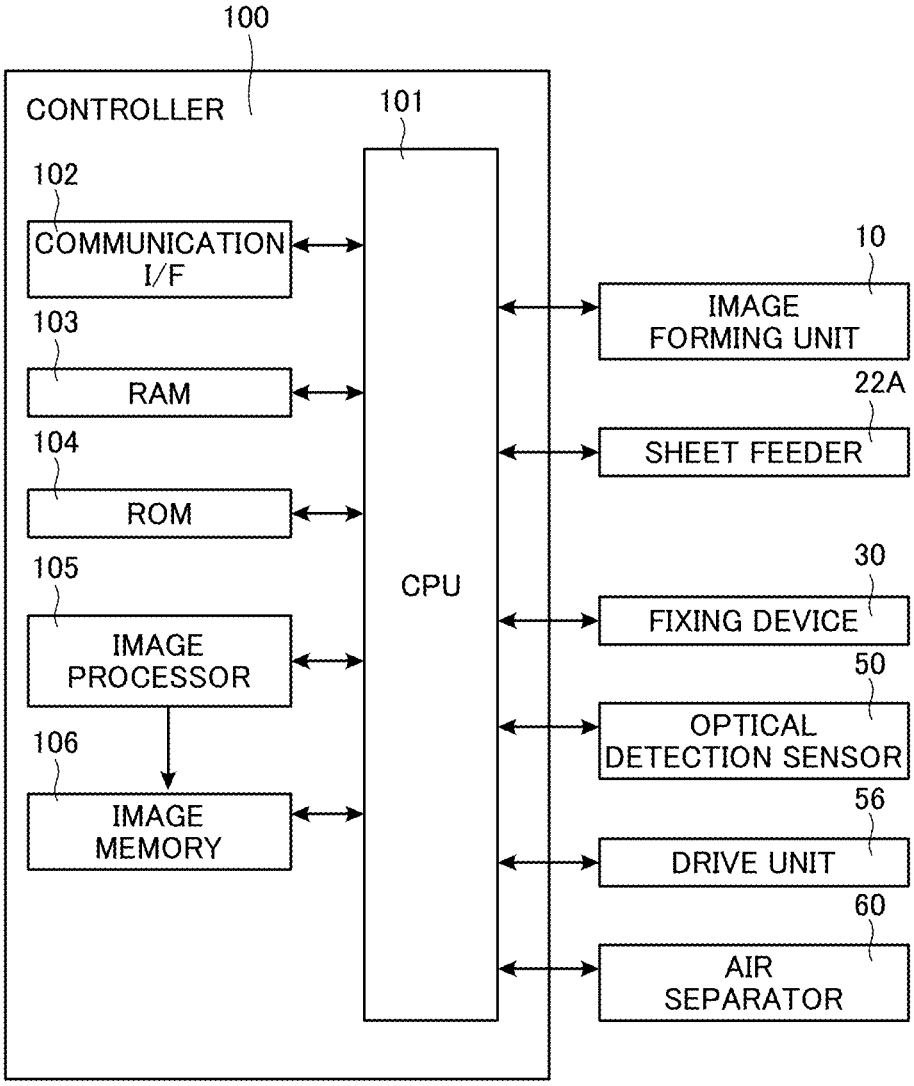
FIG. 7 is a block diagram showing an arrangement of a controller of the image forming apparatus according to the above embodiment.

In this embodiment, as shown in FIG. 7, the controller 100 calculates the gloss of the sheet material S based on an output from the optical detection sensor 50 and evaluates the performance of separating the sheet material S based on the calculated gloss. According to the calculated performance of separating the sheet material S, the controller 100 controls the operation of the air separator 60 as the separator.

Next, description is made on the performance of separating the sheet material S in the fixing device 30 and the gloss of the toner image on the sheet material S.

Figure 4A:
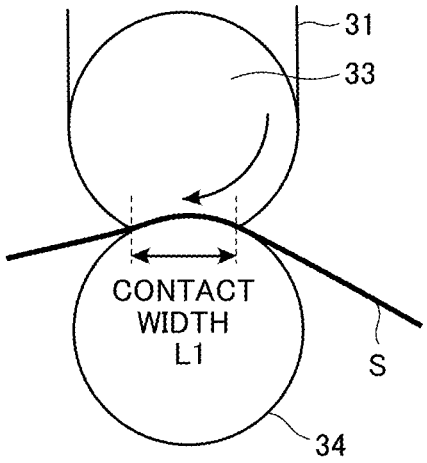
Figure 4B:
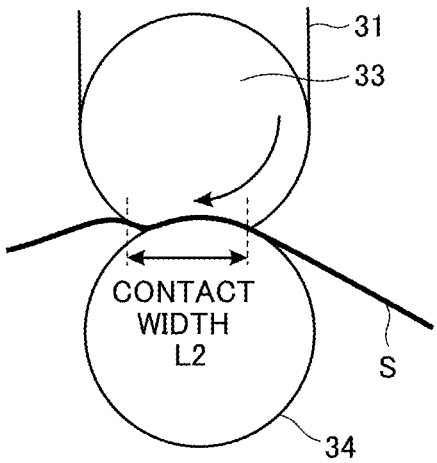
FIG. 4B is a schematic explanatory diagram showing a state where the fixing device exhibits a low sheet separating performance in the image forming apparatus according to the above embodiment.

FIG. 4A and FIG. 4B show the difference of the performance of separating the sheet material S. FIG. 4A shows a state of good sheet separating performance while FIG. 4*b* shows a state of poor sheet separating performance. The state of poor sheet separating performance means that the sheet is indicating a high likelihood of occurrence of separation failure but is finally separated. The separation failure means a state where the sheet is not separated in the end.

In the state of good sheet separating performance, as shown in FIG. 4A, the sheet material S is advanced in a direction tangential to a nip exit after passage through the nip between the pressure roller 34 and the fixing belt 31.

On the other hand, in the state of poor sheet separating performance as shown in FIG. 4B, after passing through the nip between the pressure roller 34 and the fixing belt 31, the sheet material S becomes adhered to the fixing belt 31 as the fixing member, but is separated therefrom finally.

By the way, the sheet separating performance is affected by the stiffness of the sheet material S. The higher the stiffness is, the more separable is the sheet material S. With decrease in stiffness, the sheet material becomes less separable. Even the sheet materials S of the same type may vary in stiffness depending upon the ambient moisture and temperature. The assurance of sheet separating performance in the range of stiffness variation dictates the need for providing a substantial margin of the sheet separating performance.

Next, the stability of the sheet separating performance is described. The sheet separating performance is affected not only by the stiffness of the sheet material S but also by air resistance on the sheet material S, stress from the sheet discharge roller 27 and the like. Therefore, the sheet separating performance is unstable in the transport direction of the sheet material S. Particularly in the state where the sheet separating performance is low but not so low as to induce the separation failure, the sheet material is subjected to the low separating performance in the sheet transport direction so that the sheet material shifts between the state of poor sheet separating performance with a large contact width L2 at the nip (see FIG. 4B) and the state of good sheet separating performance with a small contact width L1 at the nip (see FIG. 4A).

In the fixing device 30, the change in the contact with at the nip causes change in the softened state of the toner so that the toner image on the sheet material S is varied in the gloss.

There is an image pattern (hereinafter, referred to as "first image pattern") which is increased in the gloss because of the toner softened and smoothened in conjunction with the increase in the contact width of the sheet at the nip. In a case where image data to be recorded represents the first image pattern, the state of poor sheet separating performance can be detected by detecting a gloss increase in the transport direction at an area of the sheet material.

Figure 5A:
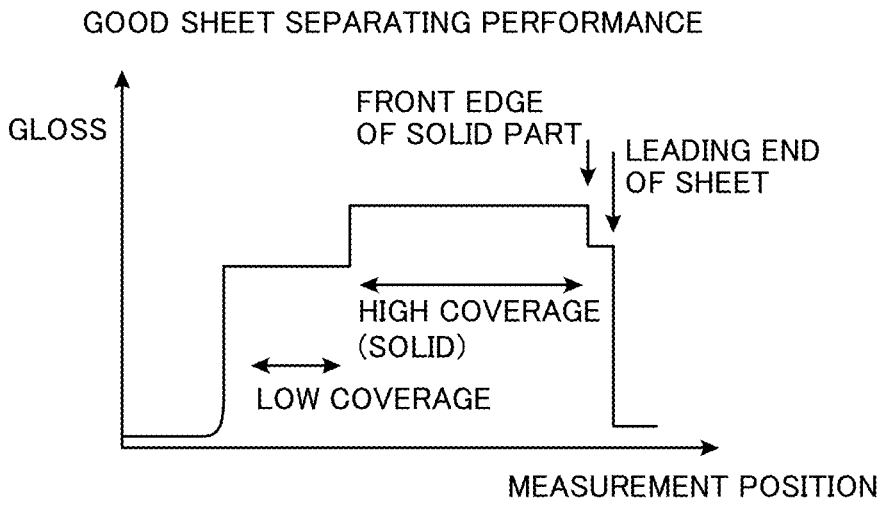
Figure 5B:
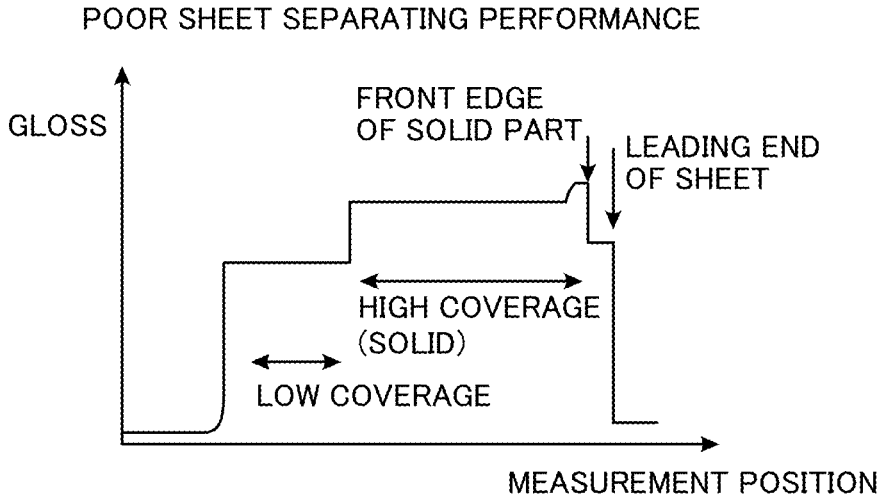
FIG. 5B is an explanatory diagram showing a measurement result of the gloss of a toner image formed on the sheet material or an example of low sheet separating performance.

FIG. 5A and FIG. 5B are conceptual diagrams showing a relation between the sheet separating performance on the first image pattern and the gloss variation in the transport direction. The first image pattern includes a solid part of high coverage formed near the leading end of the sheet and a low coverage part contiguous to the solid part. In the state of good sheet separating performance, as shown in FIG. 5A, the solid part contains no area varied in gloss. In the state of poor sheet separating performance as shown in FIG. 5B, however, the gloss at a front edge of the solid part is higher than that at the other area of the solid part. Therefore, the state of poor sheet separating performance can be detected by detecting the gloss of the fixed toner image on the sheet material S by means of the optical detection sensor 50 and detecting the gloss increase in the transport direction at a part of the sheet material.

Figure 6:
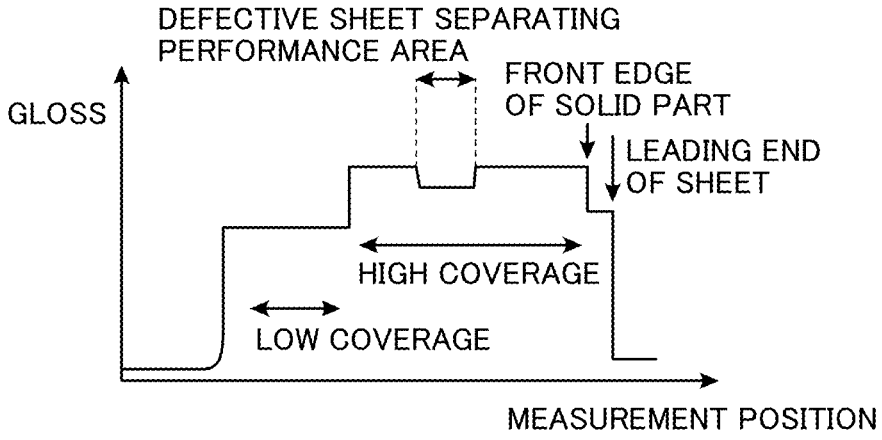
FIG. 6 is an explanatory diagram showing a measurement result of the gloss of a toner image formed on the sheet material in the image forming apparatus according to the above embodiment or an example of low sheet separating performance.

There is an image pattern (hereinafter, referred to as "second image pattern") which is decreased in the gloss in conjunction with the increase in toner surface roughness. When the sheet is increased in the contact width at the nip because of the lowered sheet separating performance, the toner is softened and decreased in viscosity so that the toner is increased in the surface roughness during sheet separation. In the case of the second image pattern, as shown in FIG. 6, the sheet separating performance is lowered at some area of the solid part, the gloss of which area is lower than that of the other area of the solid part. In this case, the state of poor sheet separating performance can be detected by detecting the gloss decrease in the transport direction at some area of the solid part by means of the optical detection sensor 50.

When the optical detection sensor 50 detects the gloss of the toner image on the sheet material S, the controller 100 first determines which of the first image pattern and the second image pattern the output image data corresponds to, before determining the sheet separating performance based on the detection result supplied by the optical detection sensor 50.

Determining that the sheet separating performance is lowered, the controller 100 controls the air separator 60 for active separation of the sheet material S from the fixing device 30. The detection of the sheet separating performance is performed on a toner deposition area of the sheet material S. Particularly, the detection is performed only when a high coverage image data is outputted. By doing so, the detection operation can be efficiently performed exclusively when a sheet material is relatively less separable from the fixing member.

For determination of the sheet separating performance, the controller 100 previously stores gloss data related to lowered sheet separating performance in conjunction with a variety of image patterns including high coverage images. The controller 100 determines the sheet separating performance by comparing the pattern of the toner image t recorded on the sheet material S with the stored gloss data related to the lowered sheet separating performance based on the gloss detected by the optical detection sensor 50.

The arrangement of the controller 100 is described with reference to FIG. 7. As shown in the figure, the controller 100 includes: a CPU 101, a communication I/F (interface) 102, a RAM 103, a ROM 104, an image processor 105, an image memory 106 and the like.

The ROM 104 stores a variety of programs such as a control program. When the image forming apparatus 1 is powered on, the CPU 101 retrieves various programs from the ROM 104 and performs a variety of operations by loading and processing the programs in the RAM 103. Since the controller 100 only has to control the image forming apparatus 1 comprehensively, the various programs, RAM 103 and ROM 104 can have any configurations.

For example, the image forming apparatus 1 can be configured such that the ROM 104 previously stores an OS for activating the controller 100 of the image forming apparatus 1 and the like, while the CPU 101 retrieves the stored OS and the like and loads them in the RAM 103 for implementing a variety of functions.

Further, the RAM 103 can be configured to include a nonvolatile memory such as a hard disk, a work RAM and the like. A variety of pieces of software are stored in the nonvolatile memory of the RAM 103, while the stored pieces of software are retrieved and loaded in the work RAM and the like to implement a variety of functions.

The RAM 103 further stores: image patterns for determination of the sheet separating performance; a variety of data pieces such as gloss values corresponding to the image patterns; data pieces of gloss detected by the optical detection sensor 50; and the like.

The CPU 101 of the controller 100 receives, through the communication I/F 102, a print job sent from a terminal device such as a personal computer via a communication network such as LAN. The data of the received print job is converted to Y, C, M, K density data representing the colors used by the image processor 105 for image development. The resultant data is further subjected to known image processing including edge enhancement, smoothing and the like, before stored in the image memory 106.

The CPU 101 determines the coverage of an image to be printed on the sheet material S, or the pattern of the toner image t by way of the image processing by the image processor 105; calculates the position of the sheet material S to be detected by the optical detection sensor 50 which will be described hereinlater; and stores the calculation result in the RAM 103. The CPU 101 also stores, in the RAM 103, the gloss data of the sheet material S based on the output from the optical detection sensor 50.

Based on the data stored in the image memory 106, the CPU 101 controls the individual imaging cartridges 10A to 10D of the image forming unit 10 to perform electric charging, light exposure and image development, to sequentially transfer the toner images of the respective colors to the intermediate transfer belt 21, and form a composite toner image on this intermediate transfer belt 21.

Further, the CPU 101 controls a sheet feeder 22A including the sheet feed roller 22 and the timing roller 23 such that the timing roller 23 feeds the sheet material S into space between the intermediate transfer belt 21 and the transfer roller 24 in a suitable timing so as to permit the toner image formed on the intermediate transfer belt 21 to be transferred to this sheet material S.

The sheet material S with the toner image t thus transferred thereto is delivered to the fixing device 30, which fixes the toner image t to the sheet material S. Subsequently, the sheet material S with the fixed toner image t is discharged by the sheet discharge roller 27.

After the sheet material S with the fixed toner image t is separated from the fixing belt 31, the gloss of the toner image t is detected by the optical detection sensor 50. The CPU 101 of the controller 100 determines the performance of separating the sheet material S from the fixing belt 31 based on the output from the optical detection sensor 50.

Figure 8:
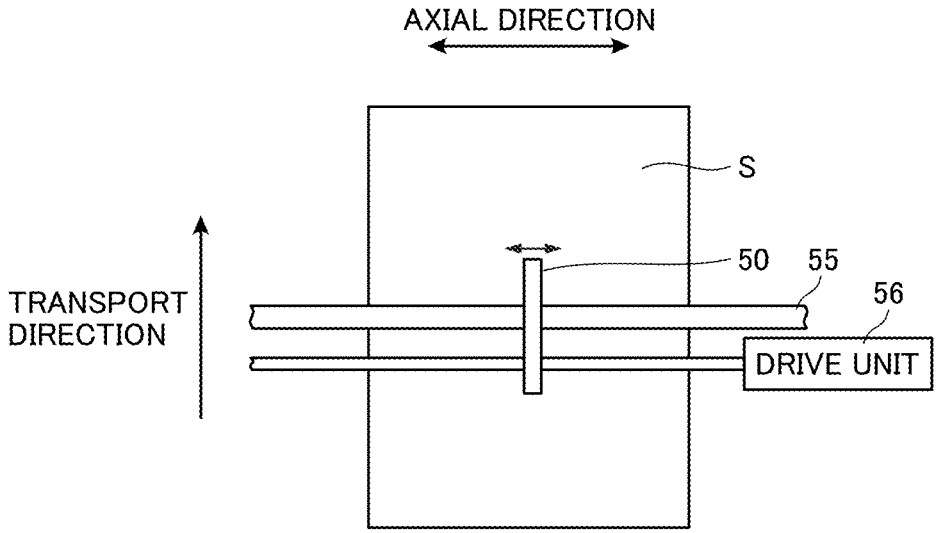
FIG. 8 is a schematic explanatory diagram showing an exemplary layout of an optical detection sensor in the image forming apparatus according to the above embodiment.

According to this embodiment, as shown in FIG. 8, the optical detection sensor 50 is movable in an axial direction (direction perpendicular to the transport direction of the sheet material S). Specifically, the optical detection sensor 50 is movably mounted on a guide rail 55 and axially moved by a drive unit 56 including a ball screw and the like.

The CPU 101 controls the drive unit 56 which moves the optical detection sensor 50 so as to permit the detection by registering the optical detection sensor with the position of the toner image t on the sheet material S. If the optical detection sensor 50 is controllably moved to a desired position, the sensor can accurately and efficiently detect the sheet separating performance with respect to any image pattern.

The gloss of the fixed image varies depending upon the coverage on the image. In this embodiment, therefore, the CPU 101 is configured to correct the detection data supplied from the optical detection sensor 50 based on the coverage of the input image data and a previously recorded relation between the coverage and the gloss, thus reducing the influence of the coverage and achieving high accuracy detection.

Since the degree of gloss after image fixation varies depending upon the type of sheet material S, the CPU 101 is configured to correct the detection data supplied from the optical detection sensor 50 based on information on a selected sheet material S and a previously recorded relation between the sheet material S and the gloss, thus reducing the influence of the difference in the quality of the sheet material S and achieving the high accuracy detection.

The CPU 101 may also be configured to determine the sheet separating performance by taking the steps of: referring to an input data and detecting the gloss at a position (blank space) free of toner deposition by means of the optical detection sensor 50; calculating the gloss of the sheet material S based on the output from the sensor; and calculating the gloss of the toner image t based on the gloss of the sheet material S. Such a configuration provides for more accurate determination of the sheet separating performance with the gloss of the sheet material S taken into consideration.

The CPU 101 of the controller 100 may also be configured to determine the sheet separating performance only when the sheet material S has low stiffness. In the case a sheet material S having the low stiffness, the sheet material S is prone to bend in conformity with the fixing belt 31 of the fixing device 30, lowering the sheet separating performance. The CPU is also adapted for efficient detection operation by providing control only in such a case where the sheet material S is relatively less separable.

Figure 9:
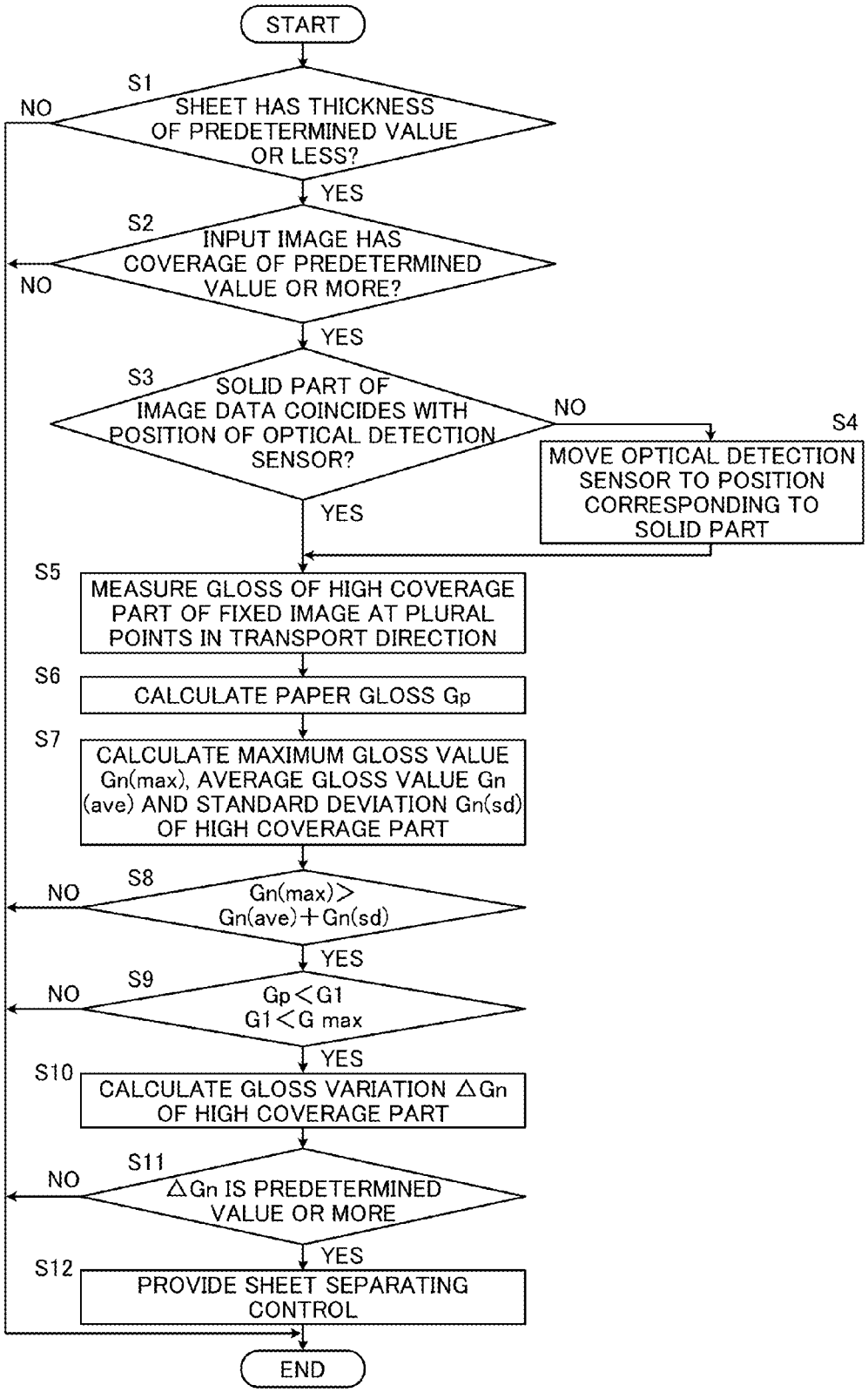
FIG. 9 is a flow chart showing the steps of an exemplary control operation performed in the image forming apparatus according to the above embodiment.

Now referring to a flow chart of FIG. 9, description is made on the operations of the CPU 101 of the controller 100 in the case where the state of sheet separating performance is detected exclusively when the sheet material has low stiffness.

In response to a print command, the CPU 101 of the controller 100 operates the image processor 105 to prepare for image formation by generating light exposure data from the input image data and such, and storing the light exposure data in the image memory 106. Then, the CPU starts the following operations to detect and evaluate the sheet separating performance. In this example, the CPU 101 determines that the input image data represents the first image pattern, and performs the operations of detecting and evaluating the sheet separating performance.

First, the CPU 101 determines whether or not the thickness of a sheet material S selected by a user is equal to or less than a predetermined value (Step S1).

If it is determined in Step S1 that the sheet material S has a thickness exceeding the predetermined value, having a high stiffness, the CPU ends its operation without providing control for forcible sheet separation. If the CPU 101 determines that the sheet material S has a thickness not more than the predetermined value, the CPU proceeds to Step S2 to detect and evaluate the sheet separating performance.

In Step S2, the CPU 101 determines whether or not the input image data includes coverage of a predetermined value or more, or whether or not the input image data includes the high coverage part. If the coverage of the input image data is less than the predetermined value, the CPU ends its operation without providing the control for forcible sheet separation because the sheet separating performance is good. If the coverage of the input image data is equal to or more than the predetermined value, the CPU 101 proceeds to Step S3 to determine whether or not the solid part of the image data coincides with the position of the optical detection sensor 50. If "Yes", the CPU proceeds to Step S5. If "No", the CPU proceeds to Step S4.

In Step S4, the CPU 101 operates the drive unit 56 to move the optical detection sensor 50 to a position corresponding to the solid part of the image data. Subsequently, the CPU 101 proceeds to Step S5.

In Step S5, the CPU 101 starts to detect the gloss from the leading end of the sheet material S. For example, the gloss is measured at plural points on the high coverage part of the fixed image at intervals of 2 mm to a trailing end of the sheet material S in the transport direction thereof.

In Step S6, the CPU 101 calculates the gloss of the blank space between the leading end of the sheet material S and the position of the image data. The calculated value is defined as the gloss Gp of this sheet material S and stored in the RAM 103. In this manner, the optical detection sensor 50 measures the gloss of the toner image t at plural points in the transport direction of the sheet material S so as to increase the accuracies of the detection of sheet separating performance based on the gloss.

In the next Step S7, the CPU 101 calculates the maximum value Gn(max) of the image gloss Gn, a Gn average value Gn(ave), and a standard deviation Gn(sd) of the high coverage part, and stores the resultant values in the RAM 103.

In Step S8, the CPU 101 determines whether or not the maximum value Gn(max) of the image gloss Gn of the high coverage part is greater than the sum of the Gn average value Gn(ave) and the standard deviation Gn(sd). If "Yes", the CPU proceeds to Step S9. If the maximum value Gn(max) is less than the sum, the CPU determines that the sheet separating performance is good and ends its operation without providing the control for forcible sheet separation.

In Step S9, the CPU 101 compares the recorded data of gloss Gp of the sheet material S and data G1 of a normal gloss range previously determined based on image coverage data so as to determine whether or not G1 is greater than Gp and whether or not the detected gloss Gn(max) is greater than G1. If "Yes" in both of the comparisons, the CPU proceeds to Step S10. If "No" in either of the comparisons, the CPU determines that the performance of separating the sheet material S is good and ends its operation without providing the control for forcible sheet separation.

In Step S10, the CPU calculates a gloss variation ΔGn of the high coverage part based on an equation Gn (max)−Gn (ave)=ΔGn.

In the next Step S11, the CPU 101 determines whether or not ΔGn is greater than a predetermined value. If "Yes", the CPU determines that the sheet separating performance is poor, and proceeds to Step S12 to provide the control for forcible sheet separation by changing the air volume of the air separator 60 to twofold of the normal level. On the other hand, if ΔGn is less than the predetermined value, the CPU determines that the performance of separating the sheet material S is good and ends its operation without providing the control for forcible sheet separation.

Further, a test pattern for evaluation of sheet separation performance is previously stored in the RAM 103 and outputted to record a toner image of the test pattern on the sheet material S. The gloss of the fixed test pattern image is detected by the optical detection sensor 50. The CPU 101 of the controller 100 evaluates the sheet separation performance based on the detection result.

Such an arrangement provides for the determination of the sheet separating performance of the fixing device 30. Therefore, how to control the separator can be set accordingly. Further, the arrangement permits the sheet separating performance of the fixing device 30 to be determined without being affected by the image pattern of the input image. By controlling the air separator 60 according to the determination result, the fixing device 30 is adapted to achieve the sheet separating performance even though the fixing device 30 is in a degraded state.

The above-described test pattern may be any pattern that enables the detection of the sheet separating performance. A desirable test pattern is made such that a belt-like toner image is longitudinally formed at place corresponding to the optical detection sensor 50.

Further, a toner image is formed in a pattern with coverage lowest at a front end thereof and progressively increased toward a tail end thereof in the transport direction. Such a pattern enables the detection of the sheet separating performance without entailing the separation failure.

The coverage may be varied by varying the amount of toner deposition on the belt-like image pattern or by varying the width of the solid image pattern.

Figure 10:
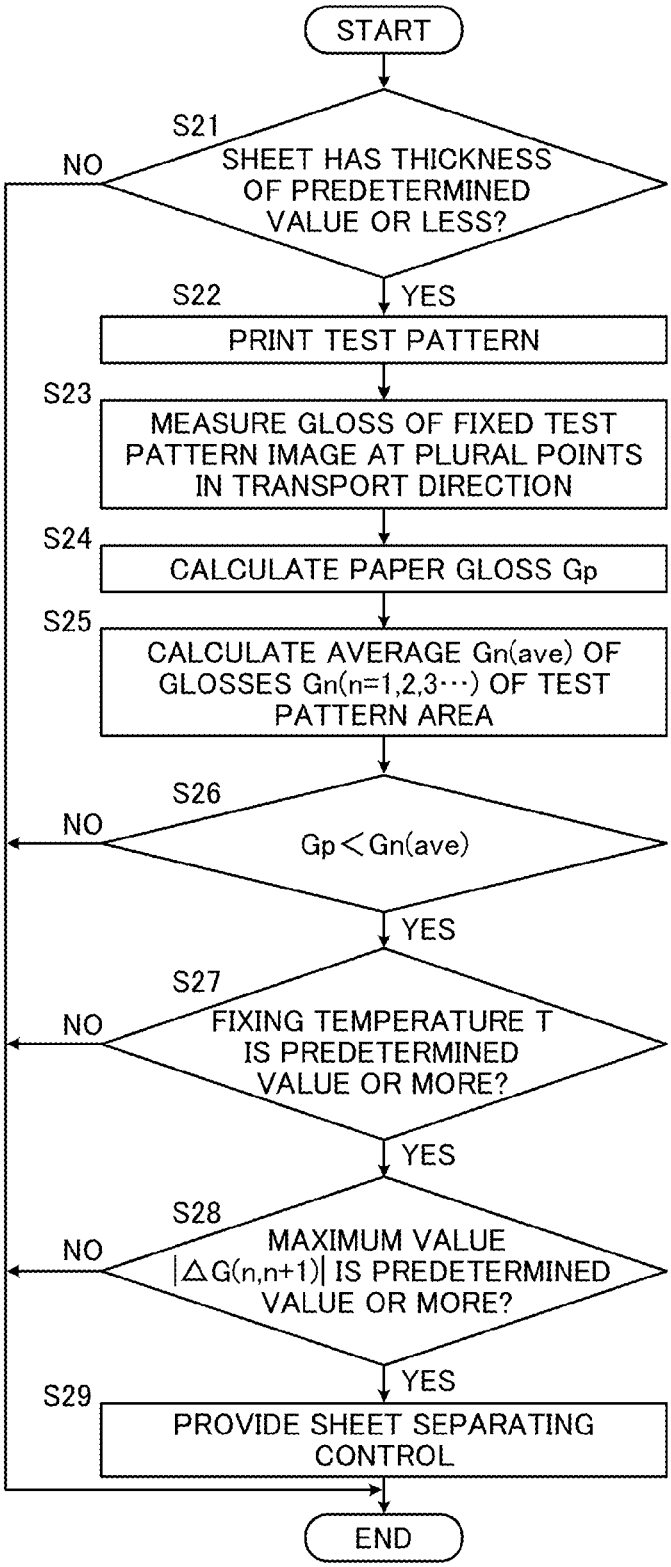
FIG. 10 is a flow chart showing the steps of another exemplary control operation performed in the image forming apparatus according to the above embodiment.

Next, referring to a flow chart of FIG. 10, description is made on the operations of the CPU 101 of the controller 100 in a case where the state of sheet separating performance is detected using the test pattern.

In response to a print command, the controller 100 prepares for image formation by generating light exposure data from the input image data and such, and starts the following operations of detecting and evaluating the sheet separating performance. In this example, the CPU 101 determines from the input image data that a test pattern image is of a first pattern and then, detects and evaluates the sheet separating performance.

First, the CPU 101 determines whether or not the thickness of a sheet material S selected by a user is equal to or less than a predetermined value (Step S21).

If the CPU determines in Step S21 that the sheet material S has a thickness more than the predetermined value and hence, has high stiffness, the CPU ends its operation without providing the control for forcible sheet separation. On the other hand, if the CPU 101 determines that the sheet material S has a thickness of the predetermined value or less, the CPU proceeds to Step S22 to detect and evaluate the sheet separating performance.

In Step S22, the CPU 101 provides control for printing the test pattern on the sheet material S.

In this embodiment, the test pattern is an overprint of two colors which has a trapezoidal solid configuration having an axial width of 5 mm at the front end and an axial maximum print width at the tail end and is positioned opposite the optical detection sensor 50. It is noted that the sheet material S includes a blank space from the leading end thereof to the position of the test pattern image data.

Subsequently, when the sheet material S is delivered to the optical detection sensor 50, the CPU 101 starts the gloss detection from the leading end of the sheet material S in Step S23. For example, the gloss of the test pattern on the sheet material S is measured at plural points at intervals of 2 mm to the trailing end of the sheet material S in the transport direction thereof.

In Step S24, the CPU 101 calculates the gloss of the blank space from the leading end of the sheet material S to the position of the image data. The gloss of the sheet material S is defined as Gp and stored in the RAM 103.

In the next Step S25, the CPU 101 calculates an average Gn(ave) of the image gloss Gn of the test pattern area and proceeds to Step S26.

In Step S26, the CPU 101 compares the gloss Gp of the sheet material S and the average Gn(ave) of the gloss of the test pattern. If Gp<Gn(ave), the CPU proceeds to Step S27. On the other hand, if the average Gn(ave) of the gloss of the test pattern is less than the gloss Gp of the sheet material, the CPU determines that the sheet separating performance is good and disables the forcible sheet separation by the air separator 60.

In Step S27, the CPU 101 determines whether or not a fixing temperature of the fixing device 30 is equal to or more than a predetermined value. If the temperature of the fixing device 30 is at the predetermined value or more, the CPU proceeds to Step S28. On the other hand, if the fixing temperature is less than the predetermined value, the CPU sets up the air separator 60 not to perform the forcible sheet separation because the sheet separating performance is good.

In the next Step S28, the CPU 101 determines whether or not the maximum absolute value of a difference Gn−G(n+1) between the glosses Gn and G(n+1) is equal to or more than a predetermined value. If the above maximum value is at the predetermined value or more, the CPU determines that the sheet separating performance is poor and proceeds to Step S29 to enable the operation by the air separator 60. On the other hand, if the above maximum value is less than the predetermined value, the CPU sets up the air separator 60 not to perform the forcible sheet separation because the sheet separating performance is good.

In a case where the printing operation is continued, the image forming apparatus 1 performs the printing operation while controlling the operation of the air separator 60 based on this setting.

When the above test pattern image is fixed, the air separator 60 is disabled so that the sheet separating performance can be determined without being affected by the air separator 60 enhancing the sheet separating performance. Thus, accurate detection of the sheet separating performance can be achieved.

In the image forming apparatus 1 of the above embodiment, the optical detection sensor 50 is movable in the axial direction. Alternatively, the structure of the image forming apparatus can be simplified by omitting the drive unit 56 and fixing the optical detection sensor 50 to one position. In this case, the optical detection sensor 50 is installed in a range where a sheet material having the minimum axial size is passed. Further, the optical detection sensor 50 may be located at any axial position that permits the optical detection sensor to detect the gloss variation associated with the difference in sheet separating performance.

If the optical detection sensor 50 is located at the axial center relative to the sheet material S, the state of the sheet material S can be detected at the center of the sheet material S, where the sheet separating performance is most significantly affected by the axial state variation of the sheet material. Therefore, the sheet separating performance can be efficiently detected by means of a single optical detection sensor 50.

Otherwise, a plurality of optical detection sensors 50 may be arranged in the axial direction. Such an arrangement provides accurate detection of the sheet separating performance even when the separability of the sheet material S varies in the axial direction.

In the case where the plural optical detection sensors 50 are arranged in the axial direction, more accurate evaluation of the sheet separating performance can be achieved by determining the sheet separating performance with reference to the detection results at corresponding positions of the sheet material S in the transport direction thereof.

At this time, if a part of the sheet material exhibits gloss variation in the transport direction while some adjoining optical detection sensors 50 also detect the gloss variation in the same direction and at a substantially corresponding position to the part, the CPU determines that the sheet separating performance has changed.

It is noted here that an area around the fixing device 30 is at high temperatures so that the detection values outputted from the optical detection sensor 50 may vary due to the influence of high temperatures. Further, some moisture contained in the toner of the fixed toner image t or in the sheet material S may evaporate therefrom, misting up the optical detection sensor 50. Hence, the detection values outputted from the optical detection sensor 50 may vary. In addition, the surface configuration of the toner of the fixed image may change. Hence, the gloss may vary with time.

Figure 11:
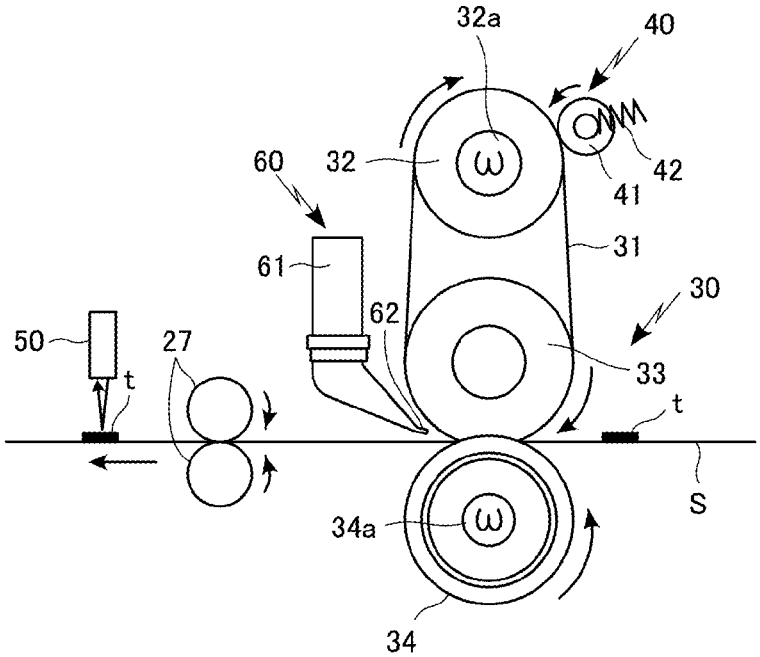
FIG. 11 is a schematic explanatory diagram showing a first modification of the fixing device for fixing the toner image to the sheet material in an image forming apparatus according to an embodiment of the invention.

As shown in FIG. 11, therefore, the gloss detection variations caused by the above-described phenomena can be suppressed by installing the optical detection sensor 50 at place downstream from the sheet discharge roller 27 on a downstream side of the fixing device 30.

Figure 12:
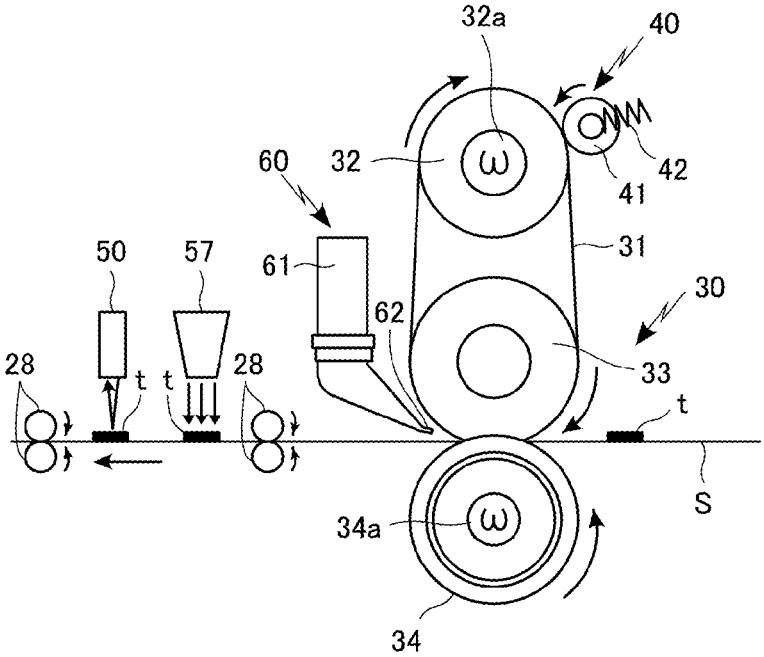
FIG. 12 is a schematic explanatory diagram showing a second modification of the fixing device for fixing the toner image to the sheet material in an image forming apparatus according to an embodiment of the invention.

The gloss variations can be further suppressed by taking measurements of the temperatures of sheet material S and the toner, and making an arrangement to lower the temperature to 50° C. or less. Accordingly, as shown in FIG. 12, a sheet discharge passage may be provided with a cooling air blower mechanism 57 for cooling the sheet material S with the fixed toner image t. Alternatively, such a cooling air blower mechanism 57 may be replaced by a contact cooling member.

If the sheet material S with the fixed toner image t is flipped or curled during the transportation through the sheet discharge passage, a positional relation between the toner image t and the optical detection sensor 50 changes so that the detected light quantity varies although the gloss stays the same. It is therefore preferred to correct for the position of the toner image on the sheet material discharged through the sheet discharge passage.

As shown in FIG. 12, for example, a pair of retention rollers 28 for stabilizing the position of the transported sheet material S can be disposed as such a correction measure at respective places upstream and downstream of the optical detection sensor 50.

According to another correction method, the correction may be made based on a measurement value of a distance from the optical detection sensor to the sheet material S. In this case, a distance between the optical detection sensor 50 and the sheet material S as measured at the position of the optical detection sensor is calculated by means of a ranging sensor, and the gloss is corrected based on data of previously calculated relation between the distance and the gloss.

While the above-described embodiment employs, as the separator, the air separator 60 which separates the sheet material S from the fixing belt 31 by blowing air against the leading end of the sheet material S just passed through the nip. However, another separator can be employed.

Figure 13:
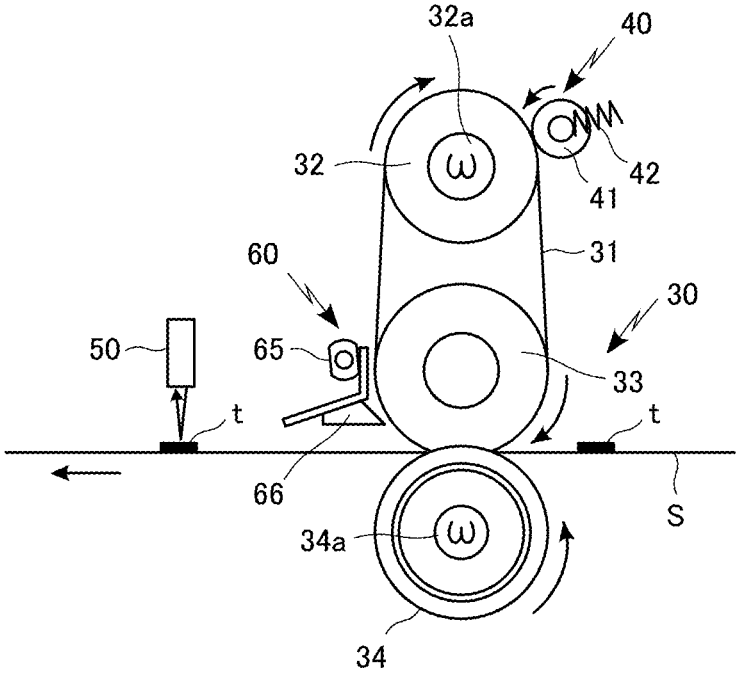
FIG. 13 is a schematic explanatory diagram showing a third modification of the fixing device for fixing the toner image to the sheet material in an image forming apparatus according to an embodiment of the invention, the fixing device employing a separation claw as a separator thereof.

For example, as shown in FIG. 13, the fixing device 30 may be provided with a separation claw 66, as the separator, which is opposed to the fixing belt 31 at place downstream from a nip exit in the transport direction. This separation claw 66 is adapted to separate the sheet material S with the fixed toner image t from the fixing belt 31. In this example, the separation claw 66 can be moved by the rotation of a cam 65. Under a condition where the sheet material S with the fixed toner image t is less separable from the fixing belt 31, the separation claw 66 is brought into contact with the fixing belt 31 or into intimate proximity thereto via a gap of several millimeters or less. Under a condition where the sheet material S with the fixed toner image t is more separable from the fixing belt 31, on the other hand, the separation claw 66 is retreated from the fixing belt 31.

The separation claw 66 may be normally disposed in contact with the surface of the fixing belt 31. However, it is more preferred that the separation claw is brought into contact with the surface of the fixing belt 31 only when the sheet material is less separable. Such an arrangement can prevent the fixing belt surface 31 from being damaged by the contact with the separation claw 66.

Figure 14:
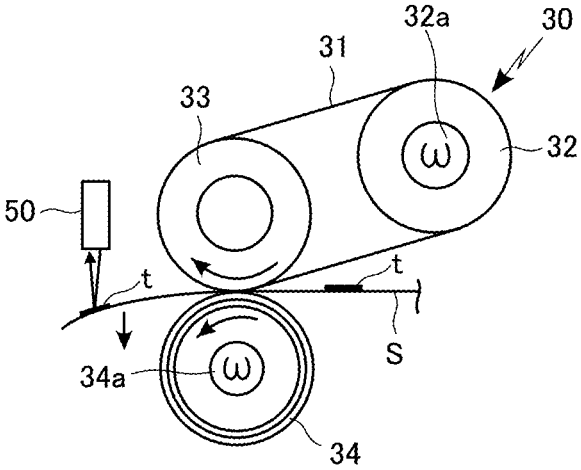
FIG. 14 is a schematic explanatory diagram showing a fourth modification of the fixing device for fixing the toner image to the sheet material in an image forming apparatus according to an embodiment of the invention, the fixing device utilizing a difference in speeds therein as a separator thereof.

As illustrated by a fixing device 30 shown in FIG. 14, the separator can be implemented by drivably rotating the above-described fixing-side pressure roller 33 with a first motor (not shown) and drivably rotating the above-described pressure roller 34 with a second variable speed motor (not shown).

The circumferential speed of the pressure roller 34 and the running speed of the above fixing belt 31 are adjusted by changing the rotational speed of the pressure roller 34 driven by the second motor whereby the separability of the sheet material S with the fixed toner image t from the fixing belt 31 can be adjusted. Specifically, if the pressure roller 34 rotated by the second motor is controlled to rotate at a circumferential speed lower than the running speed of the fixing belt 31, the sheet material S clamped by the fixing belt 31 and the pressure roller 34 is transported as bent toward the pressure roller 34 because of the higher feeding speed by the fixing belt 31 than the circumferential speed of the pressure roller 34. Thus, the sheet material S with the fixed toner image t becomes more separable from the fixing belt 31.

Figure 15:
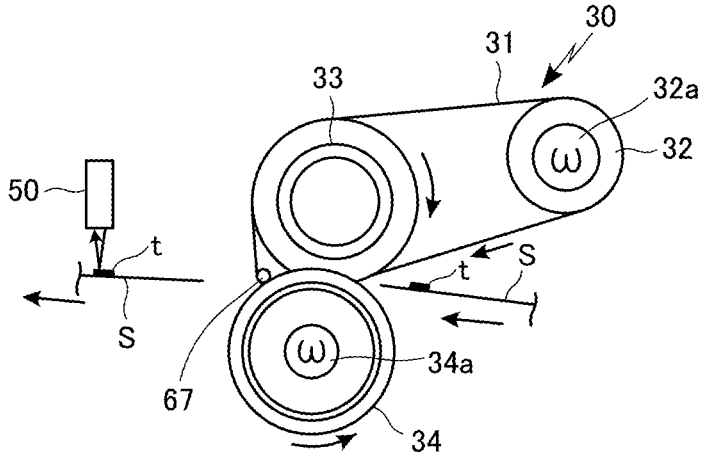
FIG. 15 is a schematic explanatory diagram showing a fifth modification of the fixing device for fixing the toner image to the sheet material in an image forming apparatus according to an embodiment of the invention, the fixing device utilizing a difference in speeds therein as a separator thereof.

As illustrated by a fixing device 30 shown in FIG. 15, the separator can be implemented by a second nip forming member 67 which is movably disposed on an inside surface of the fixing belt 31 and at place downstream from the nip formed by the above-described pressure roller 34 and fixing-side pressure roller 33. The second nip forming member 67 is so movable as to be pressed against the pressure roller 34, so that a second nip can be formed between the second nip forming member 67 and the pressure roller 34.

The curvature of the fixing belt 31 at an exit of the second nip is changed by moving the second nip forming member 67 pressed against the pressure roller 34, so that the performance of separating the sheet material S with the fixed toner image t from the fixing belt 31 is adjusted. In a case where the sheet material S is less separable from the fixing belt 31, the curvature of the fixing belt 31 at the exit of the second nip is increased so as to make the sheet material S more separable from the fixing belt 31.

The separator can also be implemented by adjusting the fixing temperature of the fixing device 30. If the fixing temperature of the fixing device 30 is lowered, the toner is changed in the melted state so that the sheet material S with the fixed toner image t becomes more separable from the fixing belt 31. In the case where the sheet material S is made more separable from the fixing belt 31 by lowering the fixing temperature of the fixing device 30, it is preferred to measure the gloss of the toner image t fixed to the sheet material S by means of the optical detection sensor 50 and to control the fixing temperature such that the gloss of the toner image t is not lowered too much relative to the sheet gloss.

The separator can also be implemented by controlling the width of the nip formed by the pressure roller 34 and the fixing-side pressure roller 33. For example, if the nip width is controllably reduced by adjusting the pressure contact between the pressure roller 34 and the fixing-side pressure roller 33, the toner is changed in the melted state so that the sheet material S with the fixed toner image t becomes more separable from the fixing belt 31. In the case where the width of the nip between the pressure roller 34 and the fixing-side pressure roller 33 is controlled in this manner, it is preferred to measure the gloss of the toner image t fixed to the sheet material S by means of the optical detection sensor 50 and to control the nip width such that the gloss of the toner image t is not lowered too much relative to the sheet floss.

The separator can also be implemented by controlling the speed of the sheet material S passed through the fixing device 30. If the speed of the sheet material S passed through the fixing device 30 is increased, for example, the sheet material S with the fixed toner image t is made more separable from the fixing belt 31.

In a case where the lowered performance of separating the sheet material S from the fixing device 30 is detected based on the increased gloss of the toner image t fixed to the sheet material S, as shown in FIG. 5B, a separator not to lower the gloss of the toner image t is used. Specifically, the above-described air separator, separation claw or the like is used as the separator such as to enhance the sheet separating performance without lowering the gloss of the toner image t.

In a case where the lowered performance of separating the sheet material S from the fixing device 30 is detected based on the decreased gloss at a portion of the solid part from that of the other portion of the solid part of the toner image t, as shown in FIG. 6, a separator adapted to lower the fixing property of the toner image t is used. Specifically, a device adapted to control the fixing temperature, to control the fixing pressure or to control the sheet feedthrough speed is used as the separator such as to enhance the sheet separating performance while stabilizing the gloss of the toner image t.

In either case shown in FIG. 5B or FIG. 6 described above, more than one of the separators illustrated in conjunction with the above-described cases can be provided in combination so as to enhance the performance of separating the sheet material S from the fixing device 30.

While the foregoing embodiments have been described by way of the example where the fixing belt 31 is provided as the fixing device 30, the pressure roller may be directly pressed against the fixing roller so as to dispense with the fixing belt 31.

Although the present invention has been described and illustrated in detail, it is clearly understood that the same is by way of illustration and example only and is not to be taken by way limitation, the scope of the present invention being interpreted by terms of the appended claims.

The invention claimed is:

1. An image forming apparatus comprising:

an image forming unit for forming a toner image and transferring the toner image to a sheet material;

a fixing device for fixing the transferred toner image to the sheet material;

a measurement device for measuring gloss of the toner image fixed to the sheet material by the fixing device;

a separator for separating the sheet material from the fixing device; and a controller which determines a performance of separating the sheet material from the fixing device based on an output from the measurement device and controls the operation of the separator.

2. The image forming apparatus according to claim 1, wherein the measurement device takes measurements on the gloss of the toner image at plural points in a transport direction of the sheet material, while the controller determines the performance of separating the sheet material based on outputs of the measurements taken by the measurement device at the plural points in the transport direction of the sheet material.

3. The image forming apparatus according to claim 1, wherein a toner image of a predetermined test pattern transferred to a sheet material is fixed to the sheet material by the fixing device, the gloss of the fixed toner image of the test pattern is measured by the measurement device, and the controller determines the performance of separating the sheet material based on the output from the measurement device.

4. The image forming apparatus according to claim 1, wherein the measurement device is movable in a direction perpendicular to a transport direction of the sheet material discharged from the fixing device, and is moved to a region where the amount of toner deposition is equal to or more than a certain value so as to measure the gloss of the toner image at the region.

5. The image forming apparatus according to claim 1, wherein the measurement device takes measurements of the gloss of the toner image at plural points in a direction perpendicular to a transport direction of the sheet material discharged from the fixing device, while the controller determines the performance of separating the sheet material based on the outputs of measurements taken by the measurement device at the plural points.

6. The image forming apparatus according to claim 1, wherein if the gloss of the toner image as measured by the measurement device is higher than a predetermined value, the controller determines that the performance of separating the sheet material is low and operates the separator without changing a fixing property of the sheet material.

7. The image forming apparatus according to claim 1, wherein if the gloss of the toner image as measured by the measurement device at a high coverage part having high gloss is lower than a predetermined value, the controller determines that the performance of separating the sheet material is low and operates the separator in a manner to lower a fixing property of the sheet material.

8. The image forming apparatus according to claim 2, wherein a toner image of a predetermined test pattern transferred to a sheet material is fixed to the sheet material by the fixing device, the gloss of the fixed toner image of the test pattern is measured by the measurement device, and the controller determines the performance of separating the sheet material based on the output from the measurement device.

9. The image forming apparatus according to claim 2, wherein the measurement device is movable in a direction perpendicular to the transport direction of the sheet material discharged from the fixing device, and is moved to a region where the amount of toner deposition is equal to or more than a certain value so as to measure the gloss of the toner image at the region.

10. The image forming apparatus according to claim 2, wherein the measurement device takes measurements of the gloss of the toner image at plural points in a direction perpendicular to the transport direction of the sheet material discharged from the fixing device, while the controller determines the performance of separating the sheet material based on the outputs of measurements taken by the measurement device at the plural points.

11. The image forming apparatus according to claim 2, wherein if the gloss of the toner image as measured by the measurement device is higher than a predetermined value, the controller determines that the performance of separating the sheet material is low and operates the separator without changing a fixing property of the sheet material.

12. The image forming apparatus according to claim 2, wherein if the gloss of the toner image as measured by the measurement device at a high coverage part having high gloss is lower than a predetermined value, the controller determines that the performance of separating the sheet material is low and operates the separator in a manner to lower a fixing property of the sheet material.

* * * * *